US005159977A

United States Patent [19]

Zabaras

[11] Patent Number: 5,159,977

[45] Date of Patent: Nov. 3, 1992

[54] ELECTRICAL SUBMERSIBLE PUMP FOR LIFTING HEAVY OILS

[75] Inventor: George J. Zabaras, Houston, Tex.

[73] Assignee: Shell Oil Company, Houston, Tex.

[21] Appl. No.: 712,280

[22] Filed: Jun. 10, 1991

[51] Int. Cl.[5] ..... E21B 43/00

[52] U.S. Cl. ..... 166/105; 166/369

[58] Field of Search ..... 166/105, 266, 369; 137/13

[56] References Cited

U.S. PATENT DOCUMENTS

| | | | |
|---|---|---|---|
| 3,886,971 | 3/1975 | Lundsgaard et al. | 137/599 |
| 3,977,469 | 8/1976 | Broussard et al. | 166/266 |
| 4,047,539 | 9/1977 | Kruka | 137/13 |
| 4,548,263 | 10/1985 | Woods | 166/105 |
| 4,745,937 | 5/1988 | Zagustin et al. | 137/13 |
| 4,749,034 | 6/1988 | Vandevier et al. | 166/105 |
| 4,753,261 | 6/1988 | Zagustin et al. | 137/13 |
| 4,832,127 | 5/1989 | Thomas et al. | 166/369 |
| 4,913,239 | 4/1990 | Bayh, III | 166/105 X |

*Primary Examiner*—Thuy M. Bui
*Attorney, Agent, or Firm*—Del S. Christensen

[57] ABSTRACT

The performance of electrical submersible pump is improved by injection of water such that the water and the oil being pumped flow in a core flow regime, reducing friction and maintaining a thin water film on the internal surfaces of the pump.

14 Claims, 1 Drawing Sheet

FIG. 1
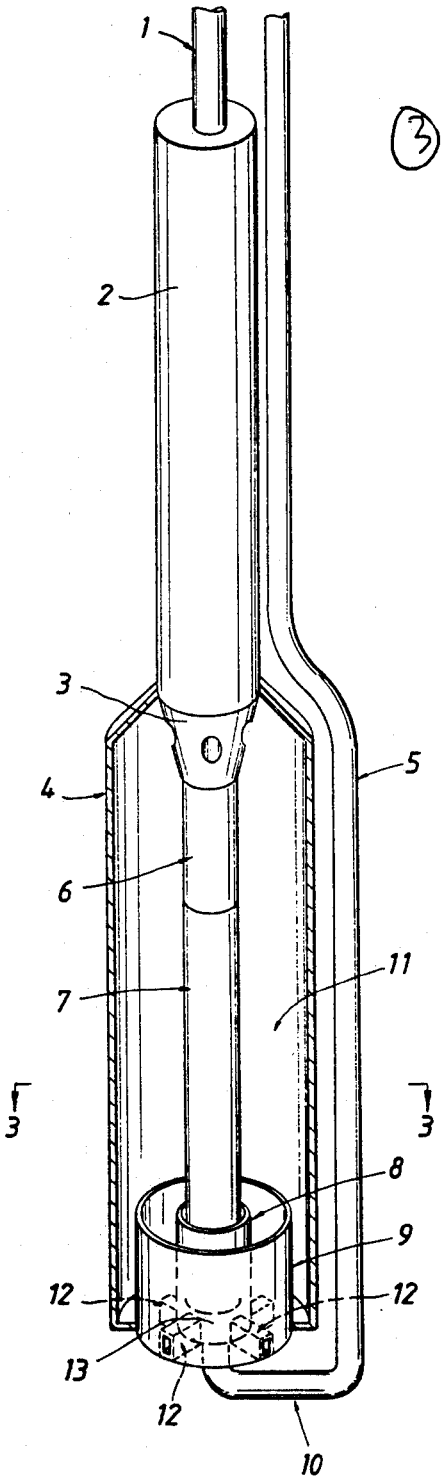
FIG. 2
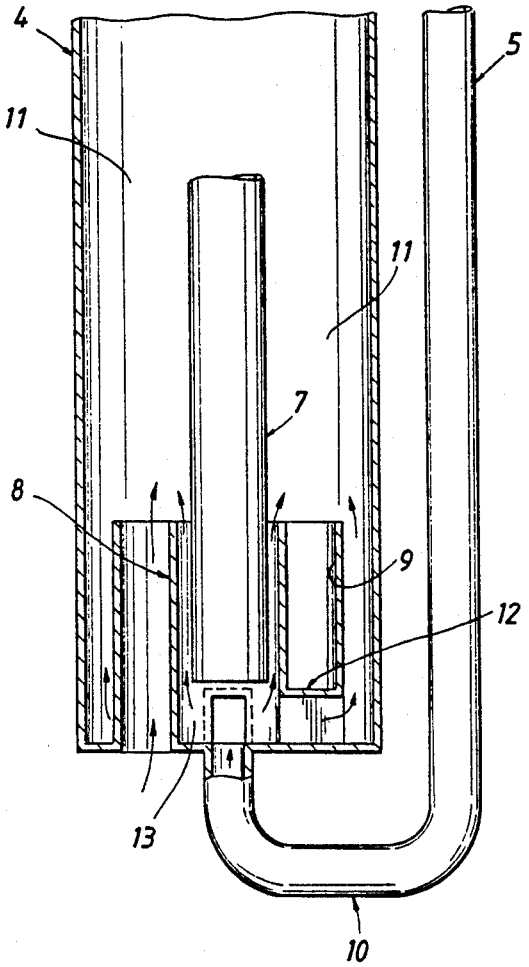
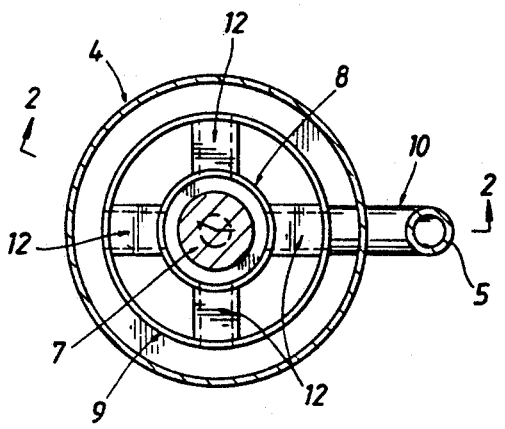
FIG. 3

ELECTRICAL SUBMERSIBLE PUMP FOR LIFTING HEAVY OILS

FIELD OF THE INVENTION

This invention relates to an improved electrical submersible pump apparatus and method for lifting viscous oils from wellbores.

BACKGROUND TO THE INVENTION

Little by little, the world's easily found and easily produced petroleum energy reserves are becoming exhausted. Consequently, to continue to meet the world's growing energy needs, ways must be found to locate and produce much less accessible and less desirable petroleum sources. Wells are now routinely drilled to depths which, only a few decades ago, were unimagined. Ways are being found to utilize and economically produce reserves previously thought to be unproducible (e.g., extremely high temperature, high pressure, corrosive, sour, and so forth). Secondary and tertiary recovery methods are being developed to recover residual oil from older wells once thought to be depleted after primary recovery methods had been exhausted.

Some crude oils (or, more broadly, reservoir fluids) have a low viscosity and are relatively easy to pump from the underground reservoir. Others have a very high viscosity even at reservoir conditions.

Sucker rod pumps may be utilized to lift viscous crude oils, but in many fields, sucker rod pumps cannot be used. For example, sucker rod pumps are not feasible in highly deviated wells. In many fields, limited surface rights make sucker rod pumps unfeasible. Offshore production must be accomplished from platforms which are expensive and have limited space available for pumping units.

Electrical submersible pumps are often used when sucker rod pumps are not feasible, but electrical submersible pumps can only pump crude oils of a viscosity of about 200 cs or less. This represents crude oils having API gravities of greater than about 12° API.

U.S. Pat. Nos. 4,832,127 and 4,749,034 disclose apparatus and processes to produce viscous crude oils from wellbores utilizing electrical submersible pumps. These inventions mix water with the crude oil at relatively high shear rates to force an emulsion to form at the inlet to the pump. The emulsion has an effective viscosity less than the viscosity of the crude oil. These inventions make it possible to produce oils otherwise not producible by electrical submersible pumps, but an excessive amount of water injection is required. For example, the process of U.S. Pat. No. '127 utilizes from 300 to 1,200 barrels a day of water to produce about 225 barrels a day of oil. This excessive amount of water results in larger pumps, motors, and surface separation equipment. Further, because an emulsion is created, surface separation equipment must be capable of breaking the emulsion.

Methods to establish core flow in pipelines are disclosed in, for example, U.S. Pat. Nos. 3,886,971, 3,977,469, 4,047,539, 4,745,937, and 4,753,261. These processes establish a core flow of a viscous fluid within a core of a less viscous fluid in order to reduce the pressure drop in the pipeline. An apparatus and process to consistently create core flow in an inlet to a submersible electric pump is not taught or suggested in these references. Further, these references do not teach or suggest that the significant problems encountered by electric submersible pumps in pumping viscous oils, i.e., motor cooling and low pump efficiencies, can be overcome by establishing core flow at the inlet of the electrical submersible pump. It is not uncommon, therefore, for example in California, to find wells with considerable quantities of valuable crude which have nevertheless not been producible because it was too expensive to produce the viscous crude.

It is therefore an object of the present invention to provide a method and an apparatus to lift viscous oils from wellbores while injecting water at a rate less than about 25 percent by weight of the total flow rate. It is a further object to provide a process and an apparatus which utilizes an electrical submersible pump to lift viscous oils from wellbores and results in electrical motor temperature rises of less than about 20° F., and pump efficiencies of greater than about 50 percent pump efficiency and greater than about 80 percent of the pump water efficiency.

SUMMARY OF THE INVENTION

The objects of the present invention are achieved by an electrical submersible pump comprising:

a) a pump section;
b) a pump inlet at the lower end of the pump;
c) a motor located below the pump which drives the pump;
d) a shroud surrounding the pump inlet and the motor defining an annular flow path between the inside of the shroud and the motor from a shroud inlet at the bottom to the pump inlet;
e) a water conduit for conducting water from the surface to the shroud inlet; and
f) a means to direct a portion of the water from the conduit to the annular flow path adjacent to the motor.

The objects of the present invention are also accomplished by a method which comprises the steps of:

providing an electrical submersible pump with a pump section, a pump inlet at the lower end of the pump section, a motor located below the pump which drives the pump, a shroud surrounding the pump inlet and the motor defining an annular flow path between the inside of the shroud and the motor from a lower shroud inlet to the pump inlet;

establishing oil-water core flow within the annular flow path with water layers flowing adjacent to the motor and adjacent to the shroud and oil flowing between the water layers; and pumping the oil-water mixture to the surface with the electrical submersible pump.

The amount of water required to establish a stable core flow is only about 10 to about 25 percent by weight of the total oil and water. The core flow established results in reasonable electric motor temperature rises and pump efficiencies. Separation of water and oil at the surface by known means is easily accomplished because an emulsion is not formed or required. When core flow is established at the shroud inlet by the method and apparatus of this invention, the core flow continues, or is readily reestablished in the production tubing above the pump. This significantly reduces the frictional pressure drop in the production tubing.

BRIEF DESCRIPTION OF THE DRAWINGS

FIG. 1 is a partially cut-away view of the apparatus of the present invention.

FIG. 2 is a partial cut-away of the apparatus which establishes core flow.

FIG. 3 is a horizontal cross section looking downward on the apparatus which establishes core flow.

DETAILED DESCRIPTION OF THE INVENTION

Referring to FIG. 1, the apparatus of the present invention is shown with a partial cut-away of a shroud, 4, exposing details of sleeves, 8 and 9, which establish core flow of water along surfaces, surrounding a flow of oil within the water. The electrical submersible pump comprises a pump section, 2, driven by a motor which is encased within the motor section, 7, with a seal section, 6, providing an essentially leak-free passage of a drive shaft (not shown) from the motor to the pump. The electrical submersible pump is suspended in the wellbore by a production tubing, 1, and a water conduit, 5, for conducting water from the surface to the electrical submersible pump. The shroud 4, encompasses the motor, 7, and pump inlet, 3, and is sealed against the pump at the lower potion of the pump. The shroud provides an annular flowpath, 11, which forces the pumped fluids to pass over the surface of the motor, 7, before entering the pump inlet, 3, to provide cooling for the motor.

Referring to FIGS. 1, 2, and 3, sleeves, 8 and 9, are provided to direct water flow up along the motor and shroud surfaces to provide core flow with oil inside of water.

Means to distribute water to the volumes between an inner sleeve, 8, and the motor, 7, and an outer sleeve, 7, and the shroud, 4, are known and not critical to the present invention. It is preferred that the water be distributed about equally between these two volumes in order to minimize the total water required. The means to distribute the water shown in FIGS. 1, 2, and 3 comprise a transfer pipe, 10, to a distribution volume, 13. The distribution volume, 13, is in communication with the volume between the outer sleeve, 9, and the shroud, 4, by channels, 12. The distribution volume is in direct communication with the volume between the inner sleeve, 8, and motor, 7. In the embodiment shown, the inner sleeve extends below the motor, and is sealed at the bottom by a plate, which prevents oil from flowing into the volume between the inner sleeve and the motor. In the embodiment shown, water flow can be distributed about equally between the inner sleeve-motor volume and the outer sleeve-shroud volume by equalizing the pressure-drop of the water flow up the inner sleeve-motor volume with the pressure drop of the flow through the conduits, 12, and up the outer sleeve-shroud volume. This can be accomplished by providing a total conduit, 12, cross-sectional flow area about equal to the cross-sectional flow area of the volume between the inner sleeve and the motor, and a cross-sectioned flow area between the outer sleeve and the shroud which is considerably larger than the cross-sectional flow area between the inner sleeve and the motor. Alternatively, and preferably, the cross-sectional flow areas between the inner sleeve and the motor is about equal to the cross-sectional flow area between the outer sleeve and the motor and less than the total cross-sectional flow areas of the conduits, 12.

The total flow cross-sectional area between outer sleeve and the shroud plus the cross-sectional flow area between the inner sleeve and the motor (water flow area) are most preferably about proportional to the cross-sectional flow area between the sleeve (oil flow area) to roughly equalize the velocities of the water and oil flowing through each volume. With about 20 percent targeted water in the total flow, the total water flow area should be about one-fourth of the oil flow area. Equalizing these flow areas equalizes the velocities exiting the sleeves and minimizes the turbulence created at the outlet of the sleeves.

It should be noted that the oil and water flow areas are generally exaggerated in FIGS. 1 through 3 in order to better show the details of the apparatus. The total average distance between the shroud and the motor may typically be between about 0.5 and 1.5 inches. This dimension is not critical to the present invention. It is limited by the dimensions of the casing within the borehole at the large end, and the need to have sufficient velocity within the annular flow area to obtain sufficient heat transfer from the motor at the lower end.

The flow areas must be of sufficient width to permit prolonged operation without becoming plugged. Generally about one-eighth-inch gaps will be sufficient to prevent plugging, although properly filtering the water injected could enable smaller gaps for the water flow paths.

The sleeves must be long enough to establish a flow path of water and oil which is generally along the vertical axis of the apparatus. Generally, 10 to 20 inches is sufficient, and about 12 inches is preferred. These lengths may be shortened if straightening vanes are located within the flow areas.

The pump apparatus may include one or more separators at the pump inlet. These inlet separators generally utilize centrifical force to remove vapors and expel the vapors back into the wellbore. Inlet separators are well known and commercially available. The use of separators does not impair the effectiveness of the core flow in reducing pumping efficiency according to this invention.

Although the description and figures have described the present invention as applied to a vertical wellbore, it is not critical that the wellbore be vertical. This invention may, in fact, be applied to horizontal or highly deviated wellbores.

The amount of water injected may be as low as 10 percent by weight of the total oil plus water pumped to the surface. Use of the minimal amount of water which results in consistent core flow is preferred. About 20 percent by weight water has been found to consistently result in core flow over a variety of pumping rates and oil viscosities. Larger percentages of water may be utilized, but result in larger pump, motor, and surface separation facilities requirements with no particular advantage.

The water injected may be salt water, brine, seawater, or fresh water. The source of the water is of no particular importance and economics can dictate the source of the water. Solid particles which can plug the water flow areas or settle out during shutdown periods are preferably removed from the water prior to injection into the water conduit. Divalent cations which could precipitate from the water upon heating to formation temperatures are also preferably not present in the water utilized.

The oil recovered by the present method may be of viscosities at reservoir temperatures of up to about 1000 cs. This corresponds to about 8° to 12° API crude oils. Lighter oils, or less viscous oils, may be produced by this process but the need to inject water becomes questionable because these lighter oils are generally producible with electric submersible pumps without core flow in water.

The following example exemplifies the present invention, but does not limit the invention.

EXAMPLES

Core flow was tested in a shallow test well in which a 50-foot long 7⅝-inch diameter casing was used. A 41-stage Reda DN1750 pump with a 20 hp 456 series motor, a 400 456 series PF SB LTM type seal, a 400 series KGS 400 type rotary gas separator, and a 5½ inch motor shroud were utilized. Mineral oil was supplied to below the shroud by a 2-inch pipe, and water was supplied to a manifold which divided the water about equally between a sleeve around the motor and a sleeve inside of the shroud. The clearance between the motor and the shroud was about 0.42 inches. The clearance between the motor and the inner sleeve was about 0.067 inches, and the clearance between the outer sleeve and the shroud was about 0.08 inches. This left about a 0.213-inch clearance between the inner and outer sleeve for oil flow into the annular flow path. The sleeves were about 14 inches long, surrounding the lower 12 inches of the motor. Communication between the water flow areas inside the inner sleeve and outside the outer sleeve by four channels located at the bottom of the sleeves. Each channel had a cross-section of a rectangular shape, about ½ by ⅝ inches.

The temperature of the mineral oil was varied to provide a viscosity which modeled 10° to 12° API crude oils at typical reservoir temperature. The production tubing was modeled by a 20-foot long 2-inch pipe connected to a horizontal insulated 3-inch pipe which was 540 feet long. A back pressure was maintained on the 3-inch pipe by a control valve at the outlet. Pump efficiency, motor surface temperature rise, and pump head were measured for conditions which varied in mctor power supply frequency (rpm), flow rate, and oil viscosity. Each test was performed at about 20 percent weight water, based on the total flow of oil and water. Table 1 includes these conditions for each test along with the results. In Table 1, the power supply frequency is varied to control the speed of the pump. The rpms of the pump are about 60 times the power supply frequency.

TABLE 1

| Run | Oil Rate B/D | Oil Visc. CS | Motor Freq. Hz | Head PSI | ESP Eff. % | ESP Water Eff. % | Motor Temp. Rise °F. |
|---|---|---|---|---|---|---|---|
| 1 | 720 | 383 | 33 | 119.0 | 54.9 | 62.0 | 2.0 |
| 2 | 720 | 383 | 36 | 141.0 | 56.9 | 59.3 | 3.6 |
| 3 | 720 | 383 | 38 | 170.5 | 55.3 | 57.5 | 4.6 |
| 4 | 720 | 383 | 40 | 196.5 | 51.1 | 55.9 | 5.8 |
| 5 | 720 | 383 | 42 | 221.9 | 49.4 | 54.3 | 7.4 |
| 6 | 720 | 383 | 45 | 253.7 | 48.6 | 51.8 | 8.9 |
| 7 | 720 | 383 | 48 | 303.2 | 47.5 | 49.7 | 10.7 |
| 8 | 720 | 383 | 51 | 346.0 | 46.7 | 47.8 | 12.9 |
| 9 | 720 | 383 | 54 | 382.1 | 45.2 | 45.7 | 12.7 |
| 10 | 549 | 377 | 33 | 109.6 | 60.9 | 66.4 | 1.5 |
| 11 | 549 | 377 | 36 | 126.3 | 58.8 | 65.7 | 3.7 |
| 12 | 549 | 377 | 38 | 141.4 | 55.8 | 65.1 | 4.4 |
| 13 | 549 | 377 | 40 | 159.3 | 55.4 | 63.8 | 4.9 |
| 14 | 549 | 377 | 45 | 228.3 | 51.9 | 60.7 | 5.7 |
| 15 | 549 | 377 | 48 | 277.2 | 51.3 | 58.5 | 7.2 |
| 16 | 549 | 377 | 51 | 309.6 | 51.8 | 56.5 | 9.0 |
| 17 | 1262 | 368 | 54 | 235.6 | 63.2 | 66.1 | 8.5 |
| 18 | 1262 | 366 | 51 | 207.0 | 57.9 | 65.3 | 9.6 |
| 19 | 1262 | 362 | 48 | 183.1 | 57.0 | 63.8 | 11.1 |
| 20 | 964 | 360 | 34 | 75.2 | 58.7 | 59.4 | 1.2 |

TABLE 1-continued

| Run | Oil Rate B/D | Oil Visc. CS | Motor Freq. Hz | Head PSI | ESP Eff. % | ESP Water Eff. % | Motor Temp. Rise °F. |
|---|---|---|---|---|---|---|---|
| 21 | 964 | 360 | 36 | 101.3 | 59.6 | 63.2 | 6.1 |
| 22 | 964 | 354 | 39 | 128.1 | 55.3 | 65.3 | 6.1 |
| 23 | 964 | 354 | 42 | 162.4 | 51.6 | 66.2 | 9.1 |
| 24 | 964 | 351 | 44 | 185.2 | 52.6 | 66.4 | 10.7 |
| 25 | 964 | 351 | 46 | 211.8 | 52.4 | 66.3 | 12.3 |
| 26 | 1262 | 340 | 45 | 115.6 | 50.5 | 58.3 | 8.8 |
| 27 | 1262 | 340 | 39 | 53.2 | 34.8 | 40.5 | 8.6 |
| 28 | 964 | 345 | 39 | 118.0 | 55.7 | 65.3 | 7.1 |
| 29 | 720 | 373 | 30 | 78.1 | 56.3 | 66.0 | 6.0 |
| 30 | 720 | 373 | 30 | 78.7 | 56.7 | 66.0 | 6.8 |
| 31 | 720 | 365 | 30 | 82.9 | 56.6 | 66.0 | 7.2 |
| 32 | 720 | 365 | 30 | 81.3 | 56.2 | 66.0 | 12.3 |

From Table 1 it can be seen that the pump efficiencies are generally within about 10 percent of those expected for pumping water, and the motor temperature rise never exceeded about 13° F. From Table 1 it can be seen that oil with viscosities of 340 cs can be pumped with this electrical submersible pump with only 20 percent weight water injection, if the injection is made through the sleeves adjacent to the motor and adjacent to the shroud.

To tests the ability of the system to start-up from temporary shut-downs, the system was filled with water and then circulation started. The core flow regime was initiated immediately. In other tests, the system was initially filled with oil. After initiating water injection coreflow was again quickly established.

The pressure drop in the horizontal pipe downstream of submersible electric pump is a good indication of the existence of annular flow in that pipe. A pressure drop of less than about two psi for the total length indicates that annular flow is established. A pressure drop of greater than about five psi indicates that the oil and water has mixed. Core flow will be more difficult to maintain within a horizontal pipe than within a vertical pipe due to gravitational forces which must be overcome to keep water at the top of the flow path in a horizontal pipe. Even with the horizontal pipe, annular flow was established at the outlet of the pump and maintained through the horizontal pipe in most of the above tests.

To determine the effect of vapor intrusion into the shroud inlet, a test was performed with nitrogen bubbling into the shroud inlet with the oil. The nitrogen was introduced in amounts of up to 50 percent by volume of the total flow. At about 50 percent by volume of the total flow, the pump lost suction. This is typical of operation on lighter oils or water. The core flow was not otherwise significantly affected by this flow of gas into the shroud inlet.

The motor cooling capabilities of the present invention are apparent from the data in Table 1 which indicate a maximum of about 13° F. injection of the present invention would be expected to be from 100° to 200° F., which results in an unacceptably short motor life.

The pump efficiencies are also within 15 percent of the water efficiencies, and generally greater than 50 percent. Pump efficiencies without the water injection of the present invention would be expected to be from 3 to 10 percent. This would result in a pump and motor size requirement which would require excessive capital costs.

Operation at reduced motor speeds is also demonstrated by the data within Table 1. The reduced motor speeds significantly reduce motor efficiencies which increases the amount of heat needed to be removed, and reduces the fluid flow available to remove that heat. The motor temperature rises remained below about 15° F. even at reduced speeds.

I claim:

1. An electrical submersible pump for producing viscous crude oil from a producing wellbore comprising:

a) a pump section;

b) a pump inlet at the lower end of the pump;

c) a motor located below the pump which drives the pump;

d) a shroud surrounding the pump inlet and the motor defining an annular flow path between the inside of the shroud and the motor from a shroud inlet at the bottom to the pump inlet;

e) a water conduit for conducting water from the surface to the shroud inlet; and f) a means to direct a portion of the water from the conduit to the annular flow path adjacent to the motor.

2. The pump of claim 1 further comprising a means to direct another portion of the water to the annular flow path adjacent to the shroud.

3. The pump of claim 1 wherein the means to direct water from the conduit to the annular flow path adjacent to the motor comprises an inside sleeve surrounding the lower portion of the motor, the sleeve open to the annular flow path at the top and defining a volume between the sleeve and the motor which is in communication with the water conduit.

4. The pump of clam 2 wherein the means to direct water from the conduit to the annular flow path adjacent to the shroud comprises an outside sleeve which is inside the shroud and the sleeve defining a volume between the sleeve and the shroud which is open to the annular flow path at the top, and in communication with the water conduit.

5. The pump of claim 4 wherein the average distance between the inside sleeve and the motor times the average diameter of the motor is about equal to the average distance between the outside sleeve and the shroud times the average diameter of the outside sleeve.

6. The motor of claim 5 wherein the average distance between the inside sleeve and the motor times the average diameter of the motor plus the average distance between the outside sleeve and the shroud times the average diameter of the outside sleeve is about one-sixteenth of the difference between the square of the average diameter of the outer sleeve minus the square of the average diameter of the inner sleeve.

7. The motor of claim 5 wherein the inner and outer sleeves are each concentric about the motor.

8. The motor of claim 5 wherein the inner and outer sleeves are each concentric about the lower portion of the motor.

9. A method for transporting viscous crude oil from a producing wellbore to the surface comprising:

providing an electrical submersible pump with a pump section, a pump inlet at the lower end of the pump section, a motor located below the pump which drives the pump, a shroud surrounding the pump inlet and the motor defining an annular flow path between the inside of the shroud and the motor from a lower shroud inlet to the pump inlet;

establishing oil-water core flow within the annular flow path with water layers flowing adjacent to the motor and adjacent to the shroud and oil flowing between the water layers; and pumping the oil-water mixture to the surface with the electrical submersible pump.

10. The method of claim 9 wherein the viscous crude oil is of a gravity less than about 12° API.

11. 10. The method of claim 10 wherein the viscous crude oil is of a gravity between about 8 and about 12° API.

12. The method of claim 9 wherein the amount of water is between about 10 and 25 percent of the total amount of water and oil pumped to the surface.

13. The method of claim 9 wherein the amount of water is between about 15 and about 25 percent by weight of the total amount of water and oil pumped to the surface.

14. The method of claim 13 wherein the amount of water is about 20 percent by weight of the total flow pumped to the surface.

* * * * *